US005756444A

United States Patent [19]

Walters et al.

[11] Patent Number: 5,756,444

[45] Date of Patent: May 26, 1998

[54] GRANULAR LAUNDRY DETERGENT COMPOSITIONS WHICH ARE SUBSTANTIALLY FREE OF PHOSPHATE AND ALUMINOSILICATE BUILDERS

[75] Inventors: Scott Alan Walters; Matthew Israel Wasserman, both of Cincinnati, Ohio

[73] Assignee: The Procter & Gamble Company, Cincinnati, Ohio

[21] Appl. No.: 742,839

[22] Filed: Nov. 1, 1996

[51] Int. Cl.[6] ..... C11D 3/00

[52] U.S. Cl. ..... 510/299; 510/351; 510/352; 510/356; 510/357; 510/361; 510/428

[58] Field of Search ..... 510/220, 221, 510/223, 230, 299, 340, 351, 352, 356, 357, 361, 427, 428

[56] References Cited

U.S. PATENT DOCUMENTS

| | | | |
|---|---|---|---|
| 2,381,960 | 8/1945 | Johnson | 210/697 |
| 4,040,988 | 8/1977 | Benson et al. | 252/532 |
| 4,299,717 | 11/1981 | Cottrell et al. | 252/99 |
| 4,490,271 | 12/1984 | Spadini et al. | 252/174.23 |
| 4,657,693 | 4/1987 | Wise et al. | 252/174.21 |
| 5,049,303 | 9/1991 | Secemski et al. | 252/548 |
| 5,378,388 | 1/1995 | Pancheri | 252/174.25 |
| 5,498,342 | 3/1996 | Chapple | 252/95 |

*Primary Examiner*—Paul Lieberman
*Assistant Examiner*—John R. Hardee
*Attorney, Agent, or Firm*—Ken K. Patel; Jacobus C. Rasser; K. W. Zerby

[57] ABSTRACT

The invention provides a granular laundry detergent composition. The composition comprises: (a) from about 1% to about 20% by weight of a surfactant; (b) from about 60% to about 90% by weight of a mixture of carbonate and sulfate, the mixture having a ratio of carbonate to sulfate of from about 4:1 to about 1:4; (c) from about 0.1% to about 15% by weight of a silicate; (d) from about 0.1% to about 5% by weight of a polycarboxylate; and (e) from about 0.1% to about 2.5% by weight of polyethylene glycol. The detergent is further characterized in that it is substantially free of aluminosilicates and phosphates.

10 Claims, No Drawings

GRANULAR LAUNDRY DETERGENT COMPOSITIONS WHICH ARE SUBSTANTIALLY FREE OF PHOSPHATE AND ALUMINOSILICATE BUILDERS

FIELD OF THE INVENTION

The present invention generally relates to granular laundry detergent compositions that are substantially free of aluminosilicate and phosphate builders.

More particularly, the detergent compositions contain selected essential detergent ingredients including silicates, polycarboxylates, polyethylene glycols, surfactants, and carbonates resulting in granular compositions which unexpectedly have excellent flow properties and cleaning performance without the use of non-reactive, insoluble aluminosilicates and phosphates.

BACKGROUND OF THE INVENTION

Aluminosilicate builders are well-known in the detergency art. They have found increasing application in heavy-duty detergent formulations as a substitute for the sodium tripolyphosphate builders, which were allegedly linked to eutrophication of ground water in the past. As a substitute for tripolyphosphate builders, aluminosilicates not only have lowered the free hardness in the wash water, but also have provided structural integrity to the detergent granules. They are often used in a mixed active system with carbonates, soil suspension antiredeposition agents such as polyethylene glycol and polyacrylate, and other cobuilders such as citrates. The most common aluminosilicates used in detergents is Zeolite A.

The biggest drawback to using aluminosilicates, or zeolites, in granular laundry detergents is their cost. Compared to their tripolyphosphate counterparts, zeolites are considerably more expensive. Accordingly, there has been commercial interest in producing low-cost detergents without zeolites. However, detergents without zeolites are generally considered inferior detergents for a number of reasons.

Without the structural support of aluminosilicates in the detergent granules, the surfactants tend to leak from the chemical matrix, rendering large-scale industrial handling and processing of the detergent more difficult. Surfactant leakage also leads to unsightly stains on the detergent packaging during storage, which makes the product less appealing to consumers. Detergent granules with leakage problems also have a tendency to "cake," which renders consumer use difficult and inconvenient.

These problems are further exaggerated at elevated temperature and humidity levels as well as during extended storage periods. Moreover, detergent granules without aluminosilicates have lower cleaning profiles because the granules cannot hold as much surfactant, in addition to the increased detrimental effects of water hardness on cleaning performance during typical home laundering operations.

Thus, there has long been a need in the detergent industry to produce less expensive detergent compositions without sacrificing chemical and physical stability of the detergent granules. However, attempts to reduce material costs by eliminating zeolites from the detergent composition have generally resulted in detergent granules with poor physical properties typified by decreased storage stability, reduced solubility in wash water leading to shoddy cleaning performance, and poor flow and handling characteristics during manufacture.

Accordingly, it would be desirable to have a granular detergent composition that is less expensive yet still exhibits excellent physical properties while providing improved cleaning performance. It would also be desirable to have such a granular detergent composition which does not include ingredients that allegedly have deleterious effects on the environment.

BACKGROUND ART

The following patents disclose detergent compositions containing sodium carbonate: Cottrell et al., U.S. Pat. No. 4,299,717; Johnson, U.S. Pat. No. 2,381,960. The following patents disclose detergent compositions containing polyacrylate and polyethylene glycol: Wise et al, U.S. Pat. No. 4,657,693; Spadini et al., U.S. Pat. No. 4,490,271; Secemski et al., U.S. Pat. No. 5,049,303. The following patent discloses the use of zeolite as a detergent structuring agent: Chappel et al., U.S. Pat. No. 5,498,342. Also, the following patents provide disclosures common to detergent compositions: Benson et al., U.S. Pat. No. 4,040,988; Pancheri et al, U.S. Pat. No. 5,378,388.

SUMMARY OF THE INVENTION

The present invention meets the needs identified above by providing granular detergent compositions that are both chemically and physically stable even under high temperature and humidity stress conditions. The detergents of the present invention also have excellent cleaning profiles as well as good physical properties. The invention achieves these results by utilizing a uniquely selected ratio of carbonate to sulfate in particular combination with specified levels of silicate, polycarboxylate, and polyethylene glycol. In addition, the present invention provides for high levels of anionic surfactant while maintaining good physical properties. Unexpectedly, the granular composition achieves both improved physical properties and cleaning performance without using aluminosilicates or phosphates.

In accordance with one aspect of the invention, a granular detergent composition without aluminosilicates or phosphates surprisingly exhibiting improved physical and cleaning properties is provided. Specifically, the granular detergent composition comprises from about 1% to about 20% of a detersive surfactant, from about 60% to about 90% of a mixture of carbonate and sulfate in a ratio of from about 4:1 to about 1:4, from about 0.1% to about 15% of a silicate, from about 0.1% to about 5% of a polycarboxylate, and from about 0.1% to about 2.5% of polyethylene glycol; and the balance comprising adjunct detergent ingredients. The composition is substantially free of aluminosilicates and phosphates. In a preferred embodiment of the invention, the polycarboxylate is sodium polyacrylate.

In another embodiment of the invention, the surfactant is selected from the group consisting of nonionic, anionic, cationic, zwitterionic and ampholytic surfactants, and mixtures thereof. Preferably, the surfactant is a mixture of linear alkyl benzene sulfonate, alkyl sulfate, and alkyl ethoxy sulfate surfactants. In a preferred embodiment of the invention, the surfactant is an anionic surfactant present in an amount of from about 6% to about 15% by weight. Optionally, the granular detergent composition further includes adjunct ingredients selected from the group consisting of bleaches, bleach activators, chelating agents, dye-transfer inhibitors, enzymes, enzyme-stabilizing agents, germicides, non-builder alkalinity sources, pH adjusting agents, polymeric soil release agents, perfumes, smectite clays and suds modifiers, and mixtures thereof.

In an especially preferred embodiment of the invention, a granular detergent composition having unexpected superior physical properties with excellent cleaning profiles is provided. The granular detergent composition contains especially selected amounts of detergent composition ingredients including: a) from about 5% to about 10% by weight of a linear alkyl benzene sulfonate surfactant; b) from about 2% to about 5% by weight of an alkyl sulfate surfactant and from about 0.5% to about 3% by weight of an alkyl ethoxylated sulfate; c) from about 15% to about 25% by weight of a carbonate; d) from about 0.5% to about 3% by weight of a silicate; e) from about 2% to about 4% by weight of a polycarboxylate; f) from about 0.8% to about 1.0% by weight of polyethylene glycol; and g) the balance comprising adjunct detergent materials. Importantly, the granular detergent composition is substantially free of aluminosilicates and phosphates, including phosphinate and other derratives of phosphinic acid. It is preferred when the composition contains from about 15% to about 25% by weight of a carbonate, that the composition also contains from about 45% to about 75% by weight of sodium sulfate.

The invention also provides a method of laundering soiled clothes comprising the step of contacting the soiled clothes with aqueous solution containing an effective amount of granular detergent composition as described herein.

Accordingly, it is an object of the present invention to provide a granular detergent composition which exhibits improved physical properties and chemical stability as well as good cleaning performance without containing aluminosilicates and phosphates. It is also an object of the present invention to provide these features in a low-cost detergent formula. These and other objects, features and attendant advantages of the present invention will become apparent to those skilled in the detergent art from a reading of the following detailed description of the preferred embodiment and the appended claims.

All percentages, ratios, and proportions used herein are by weight, unless otherwise specified. All documents including patents and publications cited herein are incorporated by reference.

DETAILED DESCRIPTION OF THE PREFERRED EMBODIMENT

In its broadest aspect, the granular detergent composition of the present invention contains a surfactant, a mixture of carbonate and sulfate in a ratio of from about 4:1 to about 1:4, preferably from about 1:1 to about 1:3, and most preferably about 1:3. Also included in the present invention are various detergent builders and dispersing agents. Preferably, the carbonate is sodium carbonate ($Na_2CO_3$) and the sulfate is sodium sulfate ($Na_2SO_4$), although other known carbonates and sulfates may be used as those skilled in the art will appreciate. The surprisingly good chemical and physical properties of the invention are especially prevalent when the detergent composition contains from about 0.1% to about 15%, preferably from about 0.5% to about 8%, most preferably from about 0.5% to about 3.0%, of a silicate material which preferably is sodium silicate ($Na_2O{\cdot}SiO_2$). In a preferred embodiment of the invention, the molar ratio of sodium monoxide to silicate is from about 1.6:1 to about 3.2:1, preferably from about 1.6:1 to about 2.0:1, most preferably about 1.6:1.

Additionally, the detergent composition contains from about 0. 1% to about 5% of a polycarboxylate, preferably from about 2% to about 4%, most preferably from about 3% to about 4%. The molecular weight of the polycarboxylate is from about 2,000 to about 10,000, preferably from about 4,000 to about 7,000, most preferably from about 4,000 to about 5,000. Additionally, the composition includes from about 0.1% to about 2.5% of polyethylene glycol, more preferably from about 0.5% to about 1.5%, and most preferably from about 0.8% to about 1.0%. The molecular weight of the polyethylene glycol is from about 1,000 to about 50,000, preferably from about 2,000 to about 20,000, most preferably from about 3,000 to about 10,000. The detergent contains no aluminosilicates or phosphates.

Sodium polyacrylate is the preferred polycarboxylate dispersing agent, however other dispersing agents are also contemplated in the present invention.

Surfactant

A detersive surfactant is included in the composition. Nonlimiting examples of surfactants useful in the surfactant mixture include the conventional $C^{u}$–$C_{18}$ alkyl benzene sulfonates ("LAS") and primary, branched-chain and random $C_{10}$–$C_{20}$ alkyl sulfates ("AS"), the $C_{10}$–$C_{18}$ secondary (2,3) alkyl sulfates of the formula $CH_3(CH_2)\times(CHOSO_3^-M^+)\ CH_3$ and $CH_3\ (CH_2)y(CHOSO_3^-M^+)\ CH_2CH_3$ where x and (y+1) are integers of at least about 7, preferably at least about 9, and M is a water-solubilizing cation, especially sodium, unsaturated sulfates such as oleyl sulfate, the $C_{10}$–$C_{18}$ alkyl alkoxy sulfates ("$AE_xS$"; especially EO 1–7 ethoxy sulfates), $C_{10}$–$C_{18}$ alkyl alkoxy carboxylates (especially the EO 1–5 ethoxycarboxylates), the $C_{10-18}$ glycerol ethers, the $C_{10}$–$C_{18}$ alkyl polyglycosides and their corresponding sulfated polyglycosides, and $C_{12}$–$C_{18}$ alpha-sulfonated fatty acid esters.

If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Mixtures of anionic surfactants are especially useful. Other conventional useful surfactants are listed in standard texts.

Detergent Builders

Detergent builders assist in controlling mineral hardness and in the removal of particulate soils. Examples of carbonates useful herein are the alkaline earth and alkali metal carbonates as disclosed in German Patent Application No. 2,321,001 published on Nov. 15, 1973. Examples of sulfates useful herein are the alkaline earth and alkali metal sulfates.

Examples of silicates are the alkali metal silicates and layered silicates, such as the layered sodium silicates described in U.S. Pat. No. 4,664,839, issued May 12, 1987 to H. P. Rieck. NaSKS-6® is the trademark for a crystalline layered silicate marketed by Hoechst (commonly abbreviated herein as "SKS-6"). Unlike zeolite builders, the Na SKS-6 silicate builder does not contain aluminum. NaSKS-6 has the delta-$Na_2SiO_5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSi_xO_{2x+1}\cdot yH_2O$ wherein M is sodium or hydrogen, x is a number from 1.9 to 4, preferably 2, and y is a number from 0 to 20, preferably 0 can be used herein. Various other layered silicates from Hoechst include NaSKS-5®, NaSKS-7® and NaSKS-11®, as the alpha, beta and gamma forms. As noted above, the delta-$Na_2SiO_5$ (NaSKS-6 form) is most preferred for use herein.

Other silicates may also be useful such as for example magnesium silicate, which can serve as a crispening agent in granular formulations, as a stabilizing agent for oxygen bleaches, and as a component of suds control systems.

Polymeric Dispersing Agents

Polymeric dispersing agents can advantageously be utilized in the compositions herein, especially in the presence of layered silicate builders. Suitable polymeric dispersing agents include polycarboxylates and polyethylene glycols, although others known in the art can also be used. It is believed, though it is not intended to be limited by theory, that polymeric dispersing agents enhance overall detergent builder performance, when used in combination with other builders (including lower molecular weight polycarboxylates) by crystal growth inhibition, particulate soil release peptization, and anti-redeposition.

Polycarboxylate materials, which can be prepared by polymerizing or copolymerizing suitable unsaturated monomers, are preferably admixed in their acid form. Unsaturated monomeric acids that can be polymerized to form suitable polycarboxylates include acrylic acid, maleic acid (or maleic anhydride), fumaric acid, itaconic acid, aconitic acid, mesaconic acid, citraconic acid and methylenemalonic acid. The presence in the polycarboxylates herein or monomeric segments, containing no carboxylate radicals such as vinylmethyl ether, styrene, ethylene, etc. is suitable provided that such segments do not constitute more than about 40% by weight.

Particularly suitable polycarboxylates can be derived from acrylic acid. Such acrylic acid-based polymers which are useful herein are the water-soluble salts of polymerized acrylic acid. The average molecular weight of such polymers in the acid form preferably ranges from about 2,000 to 10,000, more preferably from about 4,000 to 7,000 and most preferably from about 4,000 to 5,000. Water-soluble salts of such acrylic acid polymers can include, for example, the alkali metal, ammonium and substituted ammonium salts. Soluble polymers of this type are known materials. Use of polyacrylates of this type in detergent compositions has been disclosed, for example, in Diehl, U.S. Pat. No. 3,308,067, issued Mar. 7, 1967. In the present invention, the preferred polycarboxylate is sodium polyacrylate.

Acrylic/maleic-based copolymers may also be used as a preferred component of the dispersing/anti-redeposition agent. Such materials include the water-soluble salts of copolymers of acrylic acid and maleic acid. The average molecular weight of such copolymers in the acid form preferably ranges from about 2,000 to 100,000, more preferably from about 5,000 to 75,000, most preferably from about 7,000 to 65,000. The ratio of acrylate to maleate segments in such copolymers will generally range from about 30:1 to about 1: 1, more preferably from about 10:1 to 2:1. Water-soluble salts of such acrylic acid/maleic acid copolymers can include, for example, the alkali metal, ammonium and substituted ammonium salts. Soluble acrylate/maleate copolymers of this type are known materials which are described in European Patent Application No. 66915, published Dec. 15, 1982, as well as in EP 193,360, published Sep. 3, 1986, which also describes such polymers comprising hydroxypropylacrylate. Still other useful dispersing agents include the maleic/acrylic/vinyl alcohol terpolymers. Such materials are also disclosed in EP 193,360, including, for example, the 45/45/10 terpolymer of acrylic/maleic/vinyl alcohol.

Polyethylene glycol (PEG) can exhibit dispersing agent performance as well as act as a clay soil removal-antiredeposition agent. Typical molecular weight ranges for these purposes range from about 500 to about 100,000, preferably from about 1,000 to about 50,000, more preferably from about 3,000 to about 10,000. Polyaspartate and polyglutamate dispersing agents may also be used. Dispersing agents such as polyaspartate preferably have an average molecular weight of about 10,000.

Adjunct Materials

The compositions herein can optionally include one or more other detergent adjunct materials or other materials for assisting or enhancing cleaning performance, treatment of the substrate to be cleaned, or to modify the aesthetics of the detergent composition (e.g., perfumes, colorants, dyes, etc.). The following are illustrative examples of detergent adjunct materials: bleaches, bleach activators, chelating agents, dye-transfer inhibitors, enzymes, enzyme-stabilizing agents, germicides, non-builder alkalinity sources, pH adjusting agents, polymeric soil release agents, perfumes, smectite clays, soil suspending agents and suds modifiers. See U.S. Pat. No. 3,936,537, issued Feb. 3, 1976 to Baskerville, Jr. et al., incorporated herein by reference.

Bleaching agents and activators are described in U.S. Pat. No. 4,412,934, Chung et al., issued Nov. 1, 1983, and in U.S. Pat. No. 4,483,781, Hartman, issued Nov. 20, 1984, both of which are incorporated herein by reference. Chelating agents are also described in U.S. Pat. No. 4,663,071, Bush et al., from Column 17,line 54 through Column 18, line 68, incorporated herein by reference. Suitable smectite clays for use herein are described in U.S. Pat. No. 4,762,645, Tucker et al, issued Aug. 9, 1988, Column 6, line 3 through Column 7, line 24, incorporated herein by reference. More adjunct detergent materials are described in greater detail below.

Dye Transfer Inhibitors

The composition of the present invention may also include one or more materials effective for inhibiting the transfer of dyes from one fabric to another during the cleaning process. Generally, such dye transfer inhibiting agents include polyvinyl pyrrolidone polymers, polyamine N-oxide polymers, copolymers of N-vinylpyrrolidone and N-vinylimidazole, manganese phthalocyanine, peroxidases, and mixtures thereof. If used, these agents typically comprise from about 0.01% to about 10% by weight of the composition, preferably from about 0.01% to about 5%, and more preferably from about 0.05% to about 2%.

More specifically, the polyamine N-oxide polymers preferred for use herein contain units having the following structural formula: $R—A_x—P$; wherein P is a polymerizable unit to which an N—O group can be attached or the N—O group can form part of the polymerizable unit or the N—O group can be attached to both units; A is one of the following structures: —NC(O)—, —C(O)O—, —S—, —O—, —N=; x is 0 or 1; and R is aliphatic, ethoxylated aliphatics, aromatics, heterocyclic or alicyclic groups or any combination thereof to which the nitrogen of the N—O group can be attached or the N—O group is part of these groups. Preferred polyamine N-oxides are those wherein R is a heterocyclic group such as pyridine, pyrrole, imidazole, pyrrolidine, piperidine and derivatives thereof. The N—O group can be represented by the following general structures:

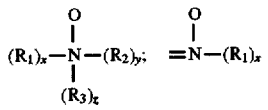

wherein $R_1$, $R_2$, $R_3$ are aliphatic, aromatic, heterocyclic or alicyclic groups or combinations thereof; x, y and z are 0 or 1; and the nitrogen of the N—O group can be attached or form part of any of the aforementioned groups. The amine oxide unit of the polyamine N-oxides has a pKa <10, preferably pKa <7, more preferred pKa <6.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof. These polymers include random or block copolymers where one monomer type is an amine N-oxide and the other monomer type is an N-oxide. The amine N-oxide polymers typically have a ratio of amine to the amine N-oxide of 10:1 to 1:1,000,000. However, the number of amine oxide groups present in the polyamine oxide polymer can be varied by appropriate copolymerization or by an appropriate degree of N-oxidation. The polyamine oxides can be obtained in almost any degree of polymerization. Typically, the average molecular weight is within the range of 500 to 1,000,000; more preferred 1,000 to 500,000; most preferred 5,000 to 100,000. This preferred class of materials can be referred to as "PVNO".

The most preferred polyamine N-oxide useful in the detergent compositions herein is poly(4-vinylpyridine-N-oxide) which has an average molecular weight of about 50,000 and an amine to amine N-oxide ratio of about 1:4.

Copolymers of N-vinylpyrrolidone and N-vinylimidazole polymers (referred to as a class as "PVPVI") are also preferred for use herein. Preferably the PVPVI has an average molecular weight range from 5,000 to 1,000,000, more preferably from 5,000 to 200,000, and most preferably from 10,000 to 20,000. (The average molecular weight range is determined by light scattering as described in Barth, et al., Chemical Analysis, Vol. 113. "Modem Methods of Polymer Characterization", the disclosures of which are incorporated herein by reference.) The PVPVI copolymers typically have a molar ratio of N-vinylimidazole to N-vinylpyrrolidone from 1:1 to 0.2:1, more preferably from 0.8:1 to 0.3:1, most preferably from 0.6:1 to 0.4:1. These copolymers can be either linear or branched.

The present invention compositions also may employ a polyvinylpyrrolidone ("PVP") having an average molecular weight of from about 5,000 to about 400,000, preferably from about 5,000 to about 200,000, and more preferably from about 5,000 to about 50,000. PVP's are known to persons skilled in the detergent field; see, for example, EP-A-262,897 and EP-A-256,696, incorporated herein by reference. Compositions containing PVP can also contain polyethylene glycol ("PEG") having an average molecular weight from about 500 to about 100,000, preferably from about 1,000 to about 10,000, more preferrably from about 3,000 to about 10,000. Preferably, the ratio of PEG to PVP on a ppm basis delivered in wash solutions is from about 2:1 to about 50:1, and more preferably from about 3:1 to about 10:1.

The detergent compositions herein may also optionally contain from about 0.005% to 5% by weight of certain types of hydrophilic optical brighteners which also provide a dye transfer inhibition action. If used, the compositions herein will preferably comprise from about 0.01% to 1% by weight of such optical brighteners.

The hydrophilic optical brighteners useful in the present invention are those having the structural formula:

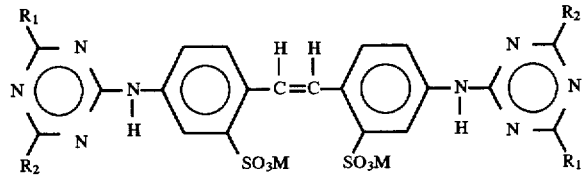

wherein $R_1$ is selected from anilino, N-2-bis-hydroxyethyl and NH-2-hydroxyethyl; $R_2$ is selected from N-2-bis-hydroxyethyl, N-2-hydroxyethyl -N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino -6-(N-2-bis-hydroxyethyl)-s-triazine-2-yl)amino]-2,2'-stilbenedisulfonic acid and disodium salt. This particular brightener species is commercially marketed under the trade name Tinopal-UNPA-GX by Ciba-Geigy Corporation. Tinopal-UNPA-GX is the preferred hydrophilic optical brightener useful in the detergent compositions herein.

When in the above formula, $R_1$ is anilino, $R_2$ is N-2-hydroxyethyl-N-2- methylamino and M is a cation such as sodium, the brightener is 4,4'-bis[(4-anilino-6-(N-2-hydroxyethyl-N-methylamino)-s-triazine-2-yl)amino]2,2'-stilbenedisulfomic acid disodium salt. This particular brightener species is commercially marketed under the trade name Tinopal 5BM-GX by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species is commercially marketed under the trade name Tinopal AMS-uX by Ciba Geigy Corporation.

The specific optical brightener species selected for use in the present invention provide especially effective dye transfer inihibition performance benefits when used in combination with the selected polymeric dye transfer inhibiting agents herein before described. The combination of such selected polymeric materials (e.g., PVNO and/or PVPVI) with such selected optical brighteners (e.g., Tinopal UNPA-GX, Tinopal 5BM-GX and/or Tinopal AMS-GX) provides significantly better dye transfer inhibition in aqueous wash solutions than does either of these two detergent composition components when used alone. Without being bound by theory, it is believed that such brighteners work this way because they have high affinity for fabrics in the wash solution and therefore deposit relatively quick on these fabrics. The extent to which brighteners deposit on fabrics in the wash solution can be defined by a parameter called the "exhaustion coefficient". The exhaustion coefficient is in general as the ratio of a) the brightener material deposited on fabric to b) the initial brightener concentration in the wash liquor. Brighteners with relatively high exhaustion coefficients are the most suitable for inhibiting dye transfer in the context of the present invention.

Of course, it will be appreciated that other, conventional optical brightener types of compounds can optionally be used in the present compositions to provide conventional fabric "brightness" benefits, rather than a true dye transfer inhibiting effect. Such usage is conventional and well-known to detergent formulations.

Enzymes

Enzymes can also be included as adjunct ingredients in the formulations herein for a wide variety of fabric laundering purposes, including removal of protein-based, carbohydrate-based, or triglyceride-based stains, for example, and for the prevention of refugee dye transfer, and for fabric restoration. The additional enzymes to be incorporated include cellulases, proteases, amylases, lipases, and peroxidases, as well as mixtures thereof. Other types of enzymes may also be included. They may be of any suitable origin, such as vegetable, animal, bacterial, fungal and yeast origin. However, their choice is governed by several factors such as pH-activity and/or stability optima, thermostability, stability versus active detergents, builders as well as their potential to cause malodors during use. In this respect bacterial or fungal enzymes are preferred, such as bacterial amylases and proteases.

Enzymes are normally incorporated at levels sufficient to provide up to about 5 mg by weight, more typically about 0.01 mg to about 3 mg, of active enzyme per gram of the composition. Stated otherwise, the compositions herein will typically comprise from about 0.001% to about 5%, preferably 0.01%–1% by weight of a commercial enzyme preparation. Protease enzymes are usually present in such commercial preparations at levels sufficient to provide from 0.005 to 0.1 Anson units (AU) of activity per gram of composition.

The cellulase suitable for the present invention include both bacterial or fungal cellulase. Preferably, they will have a pH optimum of between 5 and 9.5. Suitable cellulases are disclosed in U.S. Pat. No. 4,435,307, Barbesgoard et al, issued Mar. 6, 1984, which discloses fungal cellulase produced from *Humicola insolens* and Humicola strain DSM1800 or a cellulase 212-producing fungus belonging to the genus Aeromonas, and cellulase extracted from the hepatopancreas of a marine mollusk (*Dolabella Auricula Solander*), suitable cellulases are also disclosed in GB-A-2,075,028; GB-A-2,095,275 and DE-OS-2,247,832. In addition, cellulase especially suitable for use herein are disclosed in WO 92-13057 (Procter & Gamble). Most preferably, the cellulases used in the instant detergent compositions are purchased commercially from NOVO Industries A/S under the product names CAREZYME® and CELLUZYME®.

Suitable examples of proteases are the subtilisins which are obtained from particular strains of *B. subtilis* and *B. licheniforms*. Another suitable protease is obtained from a strain of Bacillus, having maximum activity throughout the pH range of 8–12, developed and sold by Novo Industries A/S under the registered trade name ESPERASE. The preparation of this enzyme and analogous enzymes is described in British Patent Specification No. 1,243,784 of Novo. Proteolytic enzymes suitable for removing protein-based stains that are commercially available include those sold under the trade names ALCALASE and SAVINASE by Novo Industries A/S (Denmark) and MAAATASE by International Bio-Synthetics, Inc. (The Netherlands). Other proteases include Protease A (see European Patent Application 130,756, published Jan. 9, 1985) and Protease B (see European Patent Application Serial No. 87303761.8, filed Apr. 28, 1987, and European Patent Application 130,756, Bott et al, published Jan. 9, 1985).

Amylases include, for example, α-amylases described in British Patent Specification No. 1,296,839 (Novo), RAPIDASE, International Bio-Synthetics, Inc. and TERMAMYL, Novo Industries.

Suitable lipase enzymes for detergent usage include those produced by microorganisms of the Pseudomonas group, such as *Pseudomonas stutzeri* ATCC 19.154, as disclosed in British Patent 1,372,034. See also lipases in Japanese Patent Application 53,20487, laid open to public inspection on Feb. 24, 1978. This lipase is available from Amano Pharmaceutical Co. Ltd., Nagoya, Japan, under the trade name Lipase P "Amano," hereinafter referred to as "Amano-P." Other commercial lipases include Amano-CES, lipases ex Chromobacter viscosum, e.g. *Chromobacter viscosum var. lipolyticum* NRRLB 3673, commercially available from Toyo Jozo Co., Tagata, Japan; and further Chromobacter viscosum lipases from U.S. Biochemical Corp., U.S.A. and Disoynth Co., The Netherlands, and lipases ex *Pseudomonas gladioli*. The LIPOLASE enzyme derived from *Humicola lanuginosa* and commercially available from Novo (see also EPO 341,947) is a preferred lipase for use herein.

Peroxidase enzymes are used in combination with oxygen sources, e.g., percarbonate, perborate, persulfate, hydrogen peroxide, etc. They are used for "solution bleaching," i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813, published Oct. 19, 1989, by O. Kirk, assigned to Novo Industries A/S.

A wide range of enzyme materials and means for their incorporation into synthetic detergent compositions are also disclosed in U.S. Pat. No. 3,553,139, issued Jan. 5, 1971 to McCarty et al. Enzymes are further disclosed in U.S. Pat. No. 4,101,457, Place et al, issued Jul. 18, 1978, and in U.S. Pat. No. 4,507,219, Hughes, issued Mar. 26, 1985, both. Enzyme materials useful for liquid detergent formulations, and their incorporation into such formulations, are disclosed in U.S. Pat. No. 4,261,868, Hora et al, issued Apr. 14, 1981. Enzymes for use in detergents can be stabilized by various techniques. Typical granular or powdered detergents can be stabilized effectively by using enzyme granulates. Enzyme stabilization techniques are disclosed and exemplified in U.S. Pat. No. 3,600,319, issued Aug. 17, 1971 to Gedge, et al, and European Patent Application Publication No. 0 199 405, Application No. 86200586.5, published Oct. 29, 1986, Venegas. Enzyme stabilization systems are also described, for example, in U.S. Pat. No. 3,519,570.

Polymeric Soil Release Agents

Any polymeric soil release agent known to those skilled in the art can optionally be employed in the granular compositions of this invention. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of washing and rinsing cycles and, thus, serve as an anchor for the hydrophilic segments. This can enable stains occurring subsequent to treatment with the soil release agent to be more easily cleaned in later washing procedures.

The polymeric soil release agents useful herein especially include those soil release agents having: (a) one or more nonionic hydrophile components consisting essentially of (i) polyoxyethylene segments with a degree of polymerization of at least 2, or (ii) oxypropylene or polyoxypropylene segments with a degree of polymerization of from 2 to 10, wherein said hydrophile segment does not encompass any oxypropylene unit unless it is bonded to adjacent moieties at each end by ether linkages, or (iii) a mixture of oxyalkylene units comprising oxyethylene and from 1 to about 30 oxypropylene units wherein said mixture contains a sufficient amount of oxyethylene units such that the hydrophile component has hydrophilicity great enough to increase the hydrophilicity of conventional polyester synthetic fiber surfaces upon deposit of the soil release agent on such surface, said hydrophile segments preferably comprising at least about 25% oxyethylene units and more preferably, especially for such components having about 20 to 30 oxypropylene units, at least about 50% oxyethylene units; or (b) one or more hydrophobe components comprising (i) $C_3$ oxyalkylene terephthalate segments, wherein, if said hydrophobe components also comprise oxyethylene terephthalate, the ratio of oxyethylene terephthalate:$C_3$ oxyalkylene terephthalate units is about 2:1 or lower, (ii) $C_4$–$C_6$ alkylene or oxy $C_4$–$C_6$ alkylene segments, or mixtures therein, (iii) poly (vinyl ester) segments, preferably polyvinyl acetate), having a degree of polymerization of at least 2, or (iv) $C_1$–$C_4$ alkyl ether or $C_4$ hydroxyalkyl ether substituents, or mixtures therein, wherein said substituents are present in the form of $C_1$–$C_4$ alkyl ether or $C_4$ hydroxyalkyl ether cellulose derivatives, or mixtures therein, and such cellulose derivatives are amphiphilic, whereby they have a sufficient level of $C_1$–$C_4$ alkyl ether and/or $C_4$ hydroxyalkyl ether units to deposit upon conventional polyester synthetic fiber surfaces and retain a sufficient level of hydroxyls, once adhered to such conventional synthetic fiber surface, to increase fiber surface hydrophilicity, or a combination of (a) and (b).

Typically, the polyoxyethylene segments of (a)(i) will have a degree of polymerization of from about 200, although higher levels can be used, preferably from 3 to about 150, more preferably from 6 to about 100. Suitable oxy $C_4$–$C_6$ alkylene hydrophobe segments include, but are not limited to, end-caps of polymeric soil release agents such as $MO_3S(CH_2)_nOCH_2CH_2O$—, where M is sodium and n is an integer from 4–6, as disclosed in U.S. Pat. No. 4,721,580, issued Jan. 26, 1988 to Gosselink.

Polymeric soil release agents useful in the present invention also include cellulosic derivatives such as hydroxyether cellulosic polymers, copolymeric blocks of ethylene terephthalate or propylene terephthalate with polyethylene oxide or polypropylene oxide terephthalate, and the like. Such agents are commercially available and include hydroxyethers of cellulose such as METHOCEL (Dow). Cellulosic soil release agents for use herein also include those selected from the group consisting of $C_1$–$C_4$ alkyl and $C_4$ hydroxyalkyl cellulose; see U.S. Pat. No. 4,000,093, issued Dec. 28, 1976 to Nicol, et al.

Soil release agents characterized by poly(vinyl ester) hydrophobe segments include graft copolymers of poly (vinyl ester), e.g., $C_1$–$C_6$ vinyl esters, preferably poly(vinyl acetate) grafted onto polyalkylene oxide backbones, such as polyethylene oxide backbones. See European Patent Application 0 219 048, published Apr. 22, 1987 by Kud, et al. Commercially available soil release agents of this kind include the SOKALAN type of material, e.g., SOKALAN HP-22, available from BASF (West Germany).

One type of preferred soil release agent is a copolymer having random blocks of ethylene terephthalate and polyethylene oxide (PEO) terephthalate. The molecular weight of this polymeric soil release agent is in the range of from about 25,000 to about 55,000. See U.S. Pat. No. 3,959,230 to Hays, issued May 25, 1976 and U.S. Pat. No. 3,893,929 to Basadur issued Jul. 8, 1975.

Another preferred polymeric soil release agent is a polyester with repeat units of ethylene terephthalate units contains 10–15% by weight of ethylene terephthalate units together with 90–80% by weight of polyoxyethylene terephthalate units, derived from a polyoxyethylene glycol of average molecular weight 300–5,000. Examples of this polymer include the commercially available material ZELCON 5126 (from DuPont) and MILEASE T (from ICI). See also U.S. Pat. No. 4,702,857, issued Oct. 27, 1987 to Gosselink.

Another preferred polymeric soil release agent is a sulfonated product of a substantially linear ester oligomer comprised of an oligomeric ester backbone of terephthaloyl and oxyalkyleneoxy repeat units and terminal moieties covalently attached to the backbone. These soil release agents are described fully in U.S. Pat. No. 4,968,451, issued Nov. 6, 1990 to J.J. Scheibel and E. P. Gosselink. Other suitable polymeric soil release agents include the terephthalate polyesters of U.S. Pat. No. 4,711,730, issued Dec. 8, 1987 to Gosselink et al, the anionic end-capped oligomeric esters of U.S. Pat. No. 4,721,580, issued Jan. 26, 1988 to Gosselink, and the block polyester oligomeric compounds of U.S. Pat. No. 4,702,857, issued Oct. 27, 1987 to Gosselink.

Preferred polymeric soil release agents also include the soil release agents of U.S. Pat. No. 4,877,896, issued Oct. 31, 1989 to Maldonado et al, which discloses anionic, especially sulfoarolyl, end-capped terephthalate esters.

If utilized, soil release agents will generally comprise from about 0.01% to about 10.0%, by weight, of the detergent compositions herein, typically from about 0.1% to about 5%, preferably from about 0.2% to about 3.0%.

Still another preferred soil release agent is an oligomer with repeat units of terephthaloyl units, sulfoisoterephthaloyl units, oxyethyleneoxy and oxy-1,2-propylene units. The repeat units form the backbone of the oligomer and are preferably terminated with modified isethionate end-caps. A particularly preferred soil release agent of this type comprises about one sulfoisophthaloyl unit, 5 terephthaloyl units, oxyethyleneoxy and oxy-1,2-propyleneoxy units in a ratio of from about 1.7 to about 1.8, and two end-cap units of sodium 2-(2-hydroxyethoxy)-ethanesulfonate. Said soil release agent also comprises from about 0.5% to about 20%, by weight of the oligomer, of a crystalline-reducing stabilizer, preferably selected from the group consisting of xylene sulfonate, cumene sulfonate, toluene sulfonate, and mixtures thereof.

Suds Modifiers

Compounds for reducing or suppressing the formation of suds can be incorporated into the compositions of the present invention. Suds suppression can be of particular importance in the so-called "high concentration cleaning process" and in front-loading European-style washing machines.

A wide variety of materials may be used as suds suppressors, and suds suppressors are well known to those skilled in the art. See, for example, Kirk Othmer Encyclopedia of Chemical Technology, Third Edition, Volume 7, pages 430–447 (John Wiley & Sons, Inc., 1979). One category of suds suppresser of particular interest encompasses monocarboxylic fatty acid and soluble salts therein. See U.S. Pat. No. 2,954,347, issued Sep. 27, 1960 to Wayne St. John. The monocarboxylic fatty acids and salts thereof used as suds suppresser typically have hydrocarbyl chains of 10 to about 24 carbon atoms, preferably 12 to 18 carbon atoms. Suitable salts include the alkali metal salts such as sodium, potassium, and lithium salts, and ammonium and alkanolammonium salts.

The detergent compositions herein may also contain non-surfactant suds suppressors. These include, for example: high molecular weight hydrocarbons such as paraffin, fatty acid esters (e.g., fatty acid triglycerides), fatty acid esters of monovalent alcohols, aliphatic $C_{18}$–$C_{40}$ ketones (e.g., stearone), etc. Other suds inhibitors include N-alkylated amino triazines such as tri- to hexa-alkylmelamines or di- to tetra-alkyldiamine chlortriazines formed as products of cyanuric chloride with two or three moles of a primary or secondary amine containing 1 to 24 carbon atoms, propylene oxide, and monostearyl phosphates such as monostearyl alcohol phosphate ester and monostearyl di-alkali metal (e.g., K, Na, and Li) phosphates and phosphate esters. The hydrocarbons such as paraffin and halo paraffin can be utilized in liquid form. The liquid hydrocarbons will be liquid at room temperature and atmospheric pressure, and will have a pour point in the range of about –40° C. and about 50° C., and a minimum boiling point not less than about 110° C. (atmospheric pressure). It is also known to utilize waxy hydrocarbons, preferably having a melting point below about 100° C. The hydrocarbons constitute a preferred category of suds suppresser for detergent compositions. Hydrocarbon suds suppressors are described, for example, in U.S. Pat. No. 4,265,779, issued May 5, 1981 to Gandolfo et al. The hydrocarbons, thus, include aliphatic, alicyclic, aromatic, and heterocyclic saturated or unsaturated hydrocarbons having from about 12 to about 70 carbon atoms. The term "paraffin," as used in this suds suppresser discussion, is intended to include mixtures of true paraffins and cyclic hydrocarbons.

Another preferred category of non-surfactant suds suppressors comprises silicone suds suppressors. This category includes the use of polyorganosiloxane oils, such as polydimethylsiloxane, dispersions or emulsions of polyorganosiloxane oils or resins, and combinations of polyorganosiloxane with silica particles wherein the polyorganosiloxane is chemisorbed or fused onto the silica. Silicone suds suppressors are well known in the art and are, for example, disclosed in U.S. Pat. No. 4,265,779, issued May 5, 1981 to Gandolfo et al and European Patent Application No. 89307851.9, published Feb. 7, 1990, by Starch, M. S.

Other silicone suds suppressors are disclosed in U.S. Pat. No. 3,455,839 which relates to compositions and processes for defoaming aqueous solutions by incorporating therein small amounts of polydimethylsiloxane fluids.

Mixtures of silicone and silanated silica are described, for instance, in German Patent Application DOS 2,124,526. Silicone defoamers and suds controlling agents in granular detergent compositions are disclosed in U.S. Pat. No. 3,933,672, Bartolotta et al, and in U.S. Pat. No. 4,652,392, Baginski et al, issued Mar. 24, 1987.

An exemplary silicone based suds suppresser for use herein is a suds suppressing amount of a suds controlling agent consisting essentially of:

(i) polydimethylsiloxane fluid having a viscosity of from about 20 cs. to about 1,500 cs. at 25° C.;

(ii) from about 5 to about 50 parts per 100 parts by weight of (i) of siloxane resin composed of $(CH_3)_3SiO_{1/2}$ units of $SiO_2$ units in a ratio of from $(CH_3)_3SiO_{1/2}$ units and to $SiO_2$ units of from about 0.6:1 to about 1.2:1; and (iii) from about 1 to about 20 parts per 100 parts by weight of (i) of a solid silica gel.

In the preferred silicone suds suppresser used herein, the solvent for a continuous phase is made up of certain polyethylene glycols or polyethylene-polypropylene glycol copolymers or mixtures thereof (preferred), or polypropylene glycol. The primary silicone suds suppresser is branched/cross-linked and preferably not linear.

To illustrate this point further, typical granular detergent compositions with controlled suds will optionally comprise from about 0.001 to about 1, preferably from about 0.01 to about 0.7, most preferably from about 0.05 to about 0.5, weight % of said silicone suds suppresser, which comprises (1) a non-aqueous emulsion of a primary antifoam agent which is a mixture of (a) a polyorganosiloxane, (b) a resinous siloxane or a silicone resin-producing silicone compound, (c) a finely divided filler material, and (d) a catalyst to promote the reaction of mixture components (a), (b) and (c), to form silanolates; (2) at least one nonionic silicone surfactant; and (3) polyethylene glycol or a copolymer of polyethylene-polypropylene glycol having a solubility in water at room temperature of more than about 2 weight %; and without polypropylene glycol. Similar amounts can be used in liquid detergent compositions, gels, etc. See also U.S. Pat. Nos. 4,978,471, Starch, issued Dec. 18, 1990, and 4,983,316, Starch, issued Jan. 8, 1991, 5,288,431, Huber et al., issued Feb. 22, 1994, and U.S. Pat. Nos. 4,639,489 and 4,749,740, Aizawa et al at column 1, line 46 through column 4, line 35.

The silicone suds suppresser herein preferably comprises polyethylene glycol and a copolymer of polyethylene glycol/polypropylene glycol, all having an average molecular weight of less than about 1,000, preferably between about 100 and 800. The polyethylene glycol and polyethylene/polypropylene copolymers herein have a solubility in water at room temperature of more than about 2 weight %, preferably more than about 5 weight %.

The preferred solvent herein is polyethylene glycol having an average molecular weight of less than about 1,000, more preferably between about 100 and 800, most preferably between 200 and 400, and a copolymer of polyethylene glycol/polypropylene glycol, preferably PPG 200/PEG 300. Preferred is a weight ratio of between about 1:1 and 1:10, most preferably between 1:3 and 1:6, of polyethylene glycol:copolymer of polyethylene-polypropylene glycol.

The preferred silicone suds suppressors used herein do not contain polypropylene glycol, particularly of 4,000 molecular weight. They also preferably do not contain block copolymers of ethylene oxide and propylene oxide, like PLURONIC L101.

Other suds suppressors useful herein comprise the secondary alcohols (e.g., 2- alkyl alkanols) and mixtures of such alcohols with silicone oils, such as the silicones disclosed in U.S. Pat. Nos. 4,798,679, 4,075,118 and EP 150,872. The secondary alcohols include the $C_6$–$C_{16}$ alkyl alcohols having a $C_1$–$C_{16}$ chain. A preferred alcohol is 2-butyl octanol, which is available from Condea under the trademark ISOFOL 12. Mixtures of secondary alcohols are available under the trademark ISALCHEM 123 from Enichem. Mixed suds suppressors typically comprise mixtures of alcohol + silicone at a weight ratio of 1:5 to 5:1.

For any detergent compositions to be used in automatic laundry washing machines, suds should not form to the extent that they overflow the washing machine. Suds suppressors, when utilized, are preferably present in a "suds suppressing amount. By "suds suppressing amount" is meant that the formulator of the composition can select an amount of this suds controlling agent that will sufficiently control the suds to result in a low-sudsing laundry detergent for use in automatic laundry washing machines.

The compositions herein will generally comprise from 0% to about 5% of suds suppresser. When utilized as suds suppressors, monocarboxylic fatty acids, and salts therein, will be present typically in amounts up to about 5%, by weight, of the detergent composition. Preferably, from about 0.5% to about 3% of fatty monocarboxylate suds suppresser is utilized. Silicone suds suppressors are typically utilized in amounts up to about 2.0%, by weight, of the detergent composition, although higher amounts may be used. This upper limit is practical in nature, due primarily to concern with keeping costs minimized and effectiveness of lower amounts for effectively controlling sudsing. Preferably from about 0.01% to about 1% of silicone suds suppresser is used, more preferably from about 0.25% to about 0.5%. As used herein, these weight percentage values include any silica that may be utilized in combination with polyorganosiloxane, as well as any adjunct materials that may be utilized. Monostearyl phosphate suds suppressors are generally utilized in amounts ranging from about 0.1% to about 2%, by weight, of the composition. Hydrocarbon suds suppressors are typically utilized in amounts ranging from about 0.01% to about 5.0%, although higher levels can be used. The alcohol suds suppressors are typically used at 0.2%-3% by weight of the finished compositions.

In order to make the present invention more readily understood, reference is made to the following examples, which are intended to be illustrative only and not intended to be limiting in scope.

EXAMPLES I–III

These Examples illustrate full formulations of the detergent compositions according to the claimed invention:

TABLE I

| | (% Weight) | | |
|---|---|---|---|
| Detergent Granule | I | II | III |
| $C_{12-13}$ linear alkylbenzene sulfonate, Na | 8.4 | 8.4 | 8.4 |
| $C_{14-15}$ alkyl sulfate, Na | 3.2 | 3.2 | 3.2 |
| $C_{14-15}$ alkyl ethoxylated (EO = 0.35) sulfate, Na | 1.3 | 1.3 | 1.3 |
| Sodium carbonate | 18.2 | 18.2 | 18.2 |
| Sodium sulfate | 58.7 | 57.6 | 55.8 |
| Sodium silicate (1.6r) | 0.7 | 1.8 | 3.6 |
| Polyacrylate, Na (M.W. = 4500) | 2.0 | 2.0 | 2.0 |
| Polyethylene glycol (M.W. = 4000) | 0.9 | 0.9 | 0.9 |
| Misc. (deaerant, water, brighteners, etc.) | 6.6 | 6.6 | 6.6 |
| Total | 100.0 | 100.0 | 100.0 |

The compositions exemplified above unexpectedly exhibit improved flow properties as evidenced, in part, by the ease with which the consumer can scoop the composition from the box after storage. This result is primarily attributed to the reduced "caking" tendency of the detergent compositions herein which is unexpected from granular compositions devoid of aluminosilicates and phosphates. One well-known technique for measuring the "caking" of the composition is to place a weight on the top of the composition as it is contained in the detergent box and store the product for a period of time. Thereafter, the weight is removed and graders judge the ability to scoop the composition. As stated, the compositions within the scope of the invention have reduced "caking" and are therefore easier to scoop from the detergent box.

The compositions exemplified herein are made via a standard spray drying process in which the surfactants, carbonate, and sulfate are formed into an aqueous slurry and subjected to a counter-current hot air stream in a tower. Spray-dried granules are formed to which the remaining detergent ingredients are added.

Having thus described the invention in detail, it will be obvious to those skilled in the art that various changes may be made without departing from the scope of the invention and the invention is not to be considered limited to what is described in the specification.

What is claimed is:

1. A granular detergent composition comprising:

a) from about 1% to about 20% by weight of a surfactant selected from the group consisting of nonionic, anionic, cationic, zwitterionic and ampholytic surfactants, and mixtures thereof;

b) from about 60% to about 90% by weight of a mixture of carbonate and sulfate, the mixture having a weight ratio of carbonate to sulfate of from about 4:1 to about 1:4;

c) from about 0.1% to about 15% by weight of sodium silicate, having a molar ratio of sodium monoxide to silicate ratio of 1:1.6;

d) from about 0.1% to about 5% by weight of a polycarboxylate;

e) from about 0.1 to about 2.5% by weight of polyethylene glycol; and f) the balance comprising adjunct detergent materials; the detergent composition being substantially free of aluminosilicates and phosphates.

2. The detergent composition of claim 1 wherein the adjunct materials are selected from the group consisting of bleaches, bleach activators, chelating agents, dye-transfer inhibitors, enzymes, enzyme-stabilizing agents, germicides, non-builder alkalinity sources, pH adjusting agents, polymeric soil release agents, perfumes, smectite clays and suds modifiers, and mixtures thereof.

3. The detergent composition of claim 1 wherein the carbonate is sodium carbonate, the sulfate is sodium sulfate, and the ratio of carbonate to sulfate is about 1:3.

4. The detergent composition of claim 1 wherein the surfactant is an anionic surfactant present in an amount of from about 6% to about 15% by weight.

5. The detergent composition of claim 1 wherein the molecular weight of the polyethylene glycol is from about 1,000 to about 50,000.

6. The detergent composition of claim 1 wherein the silicate is present in an amount of from about 0.5% to about 8% by weight.

7. The detergent composition of claim 1 wherein the polycarboxylate is present in an amount of from about 2% to about 4% by weight.

8. The detergent composition of claim 7 wherein the polycarboxylate is sodium polyacrylate.

9. The detergent composition of claim 8 wherein the molecular weight of the sodium polyacrylate is from about 2,000 to about 10,000.

10. A method of laundering soiled fabrics comprising the step of contacting said soiled fabrics with an aqueous solution containing an effective amount of a detergent composition according to claim 1.

* * * * *